United States Patent [19]

Duveyoung

[11] 4,362,301

[45] Dec. 7, 1982

[54] MULTIPLE IMAGE VISUAL PUZZLE AND METHOD

[76] Inventor: Edward W. Duveyoung, 2052 Wilkins Ave., Apt. #19, Napa, Calif. 94558

[21] Appl. No.: 217,360

[22] Filed: Dec. 17, 1980

[51] Int. Cl.[3] ..... A63F 9/06

[52] U.S. Cl. ..... 273/157 A

[58] Field of Search ..... 273/155, 157 A

[56] References Cited

U.S. PATENT DOCUMENTS 1,552,406 9/1925 Akerbladh ..... 273/155 UX

FOREIGN PATENT DOCUMENTS 2351623 4/1975 Fed. Rep. of Germany ... 273/157 A
3828 of 1911 United Kingdom ..... 273/157 A
621701 4/1949 United Kingdom ..... 273/157 A
743749 1/1956 United Kingdom ..... 273/157 A

*Primary Examiner*—Anton O. Oechsle
*Attorney, Agent, or Firm*—Townsend and Townsend

[57] ABSTRACT

A puzzle is produced by a method which codifies a number of images onto an equal number of partial image sheets so that by the proper arrangement and registry of the sheets any of the individual images can be reproduced. The individual images are first reproduced on transparent image sheets, preferably using different colors of transparent ink. The partial image sheets are made of a transparent material and have various portions of the images formed on one or both of their sides using opaque black ink for the dark areas of the images and opaque white ink for the background areas. Codification of each image onto the partial image sheets is accomplished by selectively overlaying the corresponding image sheet with one or more of the other image sheets or previously codified partial image sheets, or both. During codification, since the sheets are necessarily transparent, some dark or light areas must be masked by the opposite (light or dark) opaque ink so that when the partial image sheets are properly registered one upon another, extraneous image portions do not intrude into the image produced or the surrounding background.

12 Claims, 27 Drawing Figures

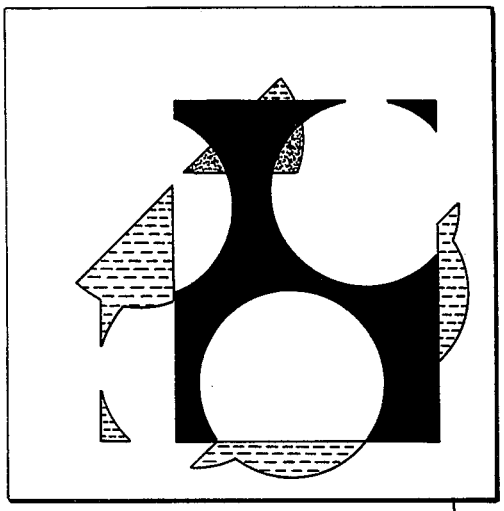
FIG._23. IA
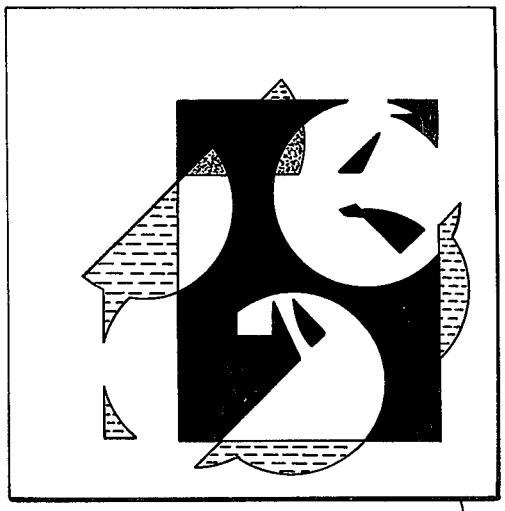
FIG._24. IA
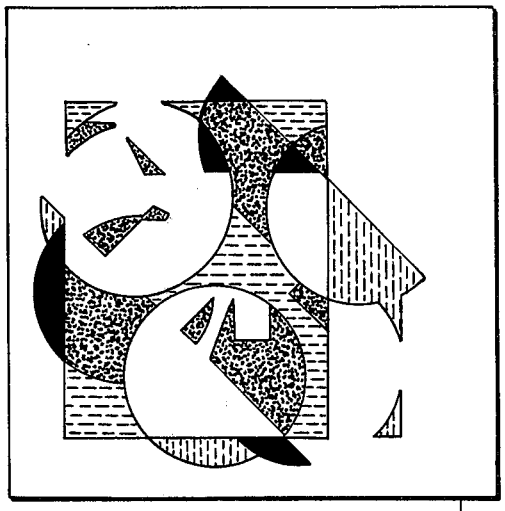
FIG._24A. IB

MULTIPLE IMAGE VISUAL PUZZLE AND METHOD

BACKGROUND OF THE INVENTION

Various sorts of visual puzzles have amused people since the earliest of time. They can be used for teaching, for occupying spare time or for simple enjoyment. One type of visual puzzle uses two or more sheets, each sheet having a portion of a single design printed thereon. The sheets are made of a transparent material so that when placed upon one another and indexed to a proper position, the multiple partial images on each individual sheets become aligned to produce the desired image. An example of such a puzzle is shown in British Pat. No. 12,693, A.D. 1897.

SUMMARY OF THE INVENTION

The multiple image visual puzzle produced by the method of the present invention allows the codification of a number of images onto an equal number of transparent sheets of material so that by proper arrangement and registry of the sheets (called partial image sheets), any of the images can be produced. To produce the visual puzzle, the user first selects the desired images and determines optimal orientation to maximize the shared dark areas. These images are then transferred to other transparent sheets preferably using different colors of transparent ink. A number of the partial image sheets, for example three for a three-image puzzle, have various portions of the images formed on one or both of their sides using opaque ink. Preferably, the dark areas of the images are indicated by black ink and the background areas are indicated by opaque white ink. Background, as used herein, means any white or light-colored area within or surrounding the dark-colored image.

Each image is codified onto the partial image sheets by selectively overlaying the image with one or more of the original images or previously codified partial image sheets, or both. For the three-image puzzle disclosed, three partial image sheets are used and each image is codified, that is, reproduced in partial image segments onto the sheets, on five of the six sides of the three partial image sheets. During codification, particularly because the sheets are necessarily transparent, some dark areas must be masked by the background color, typically white, so that when the partial image sheets are properly registered one upon another, partial image portions on the reverse side of the top partial image sheet, as well as on the underlying partial image sheets, do not add extraneous image portions to the image produced.

A key aspect to the invention is the separation of the images into partial images, termed codification, onto a number of partial image sheets. The segmentation of the images into partial images is accomplished by adding and subtracting portions of the other images by partially overlaying the images with either other images or other partial images on other partial image sheets. In addition, portions of the partial images of some images are used in producing, or filling in, other images. Therefore, if one were to remove all the dark partial image areas from the various partial image sheets, the portions would generally not be capable of being fitted together to make all of the images simultaneously because of their interdependent nature. By using the images and the partial images themselves to create the partial images on the partial image sheets, a number of images can be codified onto a like number of partial image sheets. Further, with the present invention all of the partial image sheets are used to produce each of the puzzle images so that a minimum number of partial image sheets need be used—that is two for a two image puzzle, three for a three-image puzzle, and so forth.

The choice of a light colored opaque medium, typically white paint, as the medium for the background color serves several functions. It produces light background areas which otherwise could be clear. It also masks over dark, typically black, partial image portions which would otherwise intrude upon the background portion of the image being produced. Further, the use of white to mask dark areas of partial images and black to mask white areas of partial images which are not desired to be viewed can cause what is in effect a negative image. This negative image can confuse the brain of the puzzle solver because an image, although perceived as a negative of one of the images, is quite often construed by the puzzle solver to be a partially formed positive image. This aspect adds to the complexity of the game.

Other features of the present invention will become apparent from the following description in which the preferred embodiment has been set forth in detail in conjunction with the accompanying drawings.

BRIEF DESCRIPTION OF THE DRAWINGS

FIGS. 6, 11, 17, 18, 23 and 24 show side 1A of the first partial image sheet resulting from different steps in the method.

FIGS. 10, 12, 13 and 24A show side 1B of the first partial image sheet resulting from different steps in the method.

DETAILED DESCRIPTION OF THE PREFERRED EMBODIMENT AND METHOD

Figure 1:
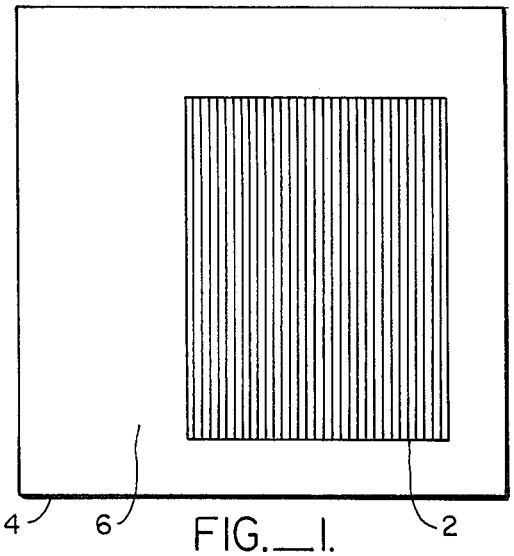
FIGS. 1–3 show the first, second and third images on pieces of transparent material.
Figure 2:
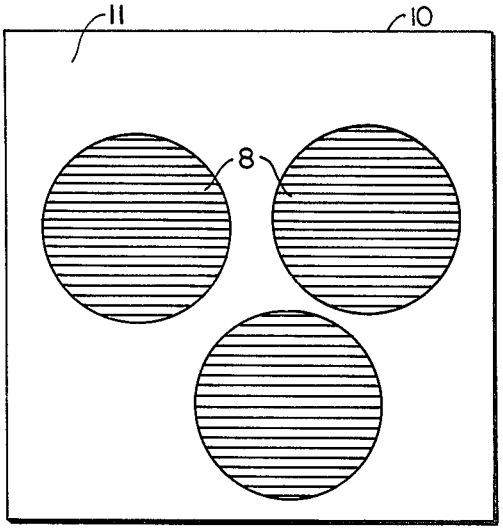
Figure 3:
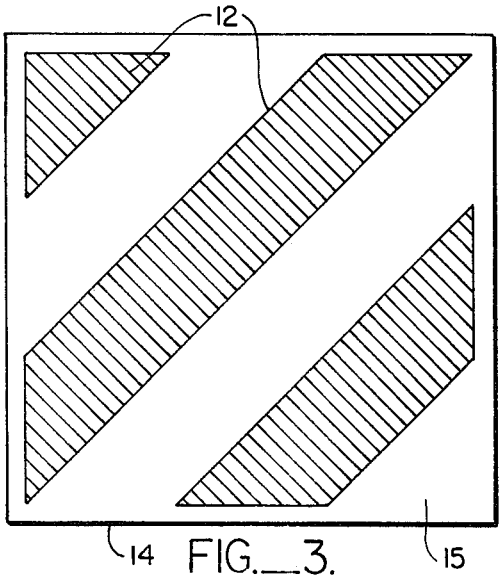

Turning now to FIGS. 1–3, the three chosen images are shown. FIG. 1 shows a first image 2, a rectangle offset from the square image area 4, the balance of the image area 4 being a transparent, preferably clear, background 6. The image area is a piece of clear material with first image 2 formed thereon using red transparent ink. A second image 8, shown in FIG. 2, is formed on a piece of clear material defining second image area 10, the balance of image area 10 being a clear background 11. The second image, comprising three circles, is produced using transparent blue ink. In FIG. 3 a third image 12 is shown and is a number of diagonal stripes on a piece of clear material defining a third image area 14, the balance of image area 14 being a clear background 15. The third image is of green transparent ink.

Figure 4:
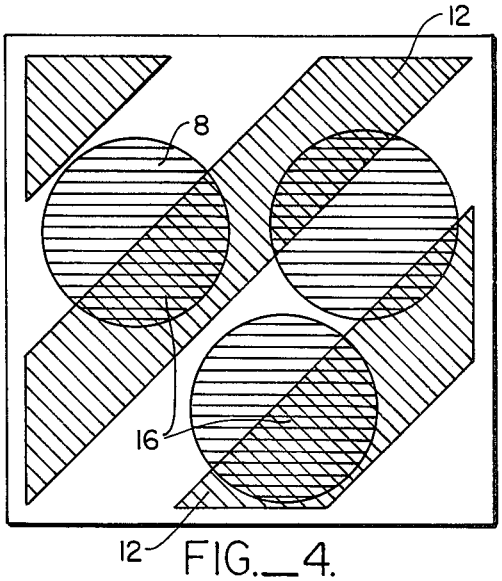
FIG. 4 illustrates the superimposition of the third image over the second image.

In FIG. 4, third image 12 is shown partially overlapping second image 8. Because transparent inks of different colors are used, the areas in which the images overlap, indicated by numeral 16, absorb more frequencies of light and appear darker and hence are more apparent to the observer. In a like manner in FIG. 5, second image 8 is shown partially overlapping first image 2, these overlapping areas indicated by numeral 18. It should be noted that the perimeters of the image areas are congruent so that each image can be easily reregistered and used for masking the other images to produce partial images as discussed in greater detail below.

Three sheets of clear plastic material are used in this three-image visual puzzle. For convenience, the sides of the partial image sheets will be designated as sides 1A and 1B for the first sheet, sides 2A and 2B for the second sheet, and sides 3A and 3B for the third sheet.

The basic formula for producing the first, second and third images from the partial images on the three partial image sheets is as follows. First image 2 is formed by registering sides 1A over 3A over 2A. Second image 8 is formed by registering sides 2A over 3A over 1B, while third image 12 is formed by registering sides 2B over 3A over 1B. Third image 12 can also be produced by registering sides 3A over 2B over 1B. It will be noticed that side 3B has no partial image portions placed thereon and is unused for image production in this three-piece puzzle.

Figure 5:
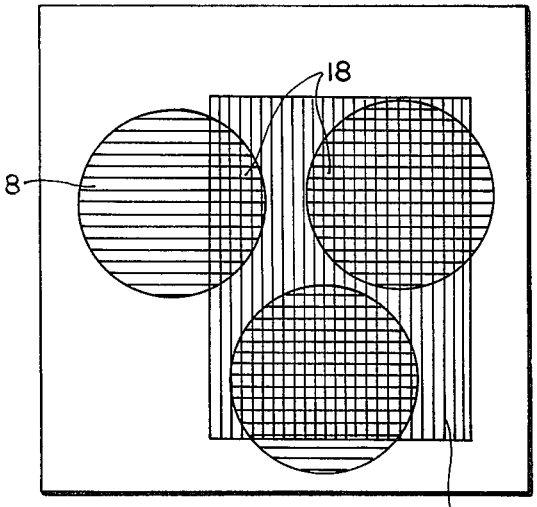
FIG. 5 illustrates the superimposition of the second image over the first image.

In the following description of an exemplary method for producing the partial image sheets, the images of FIGS. 1–3 and the overlapping images of FIGS. 4–5 will be referred to in the following manner. The image areas and images of FIGS. 1–3 will be referred to as simply FIG. 1 or FIG. 2 or FIG. 3. When the third image 12 is registered over second image 8 as in FIG. 4, that arrangement will be designated FIG. 4. Similarly, when first image 2 is registered over second image 8 as shown in FIG. 5, that arrangement will be designated FIG. 5.

Codification of the First Image

Figure 6:
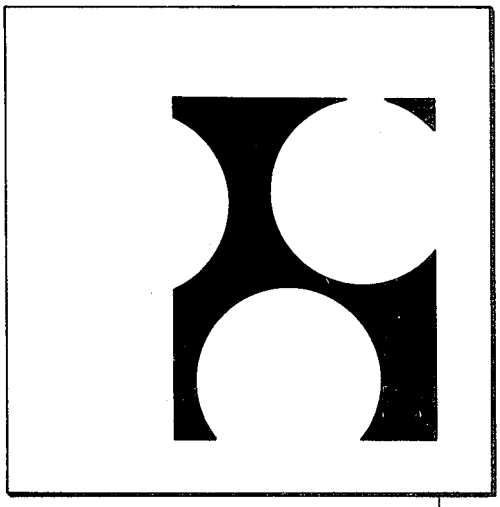
Figure 7:
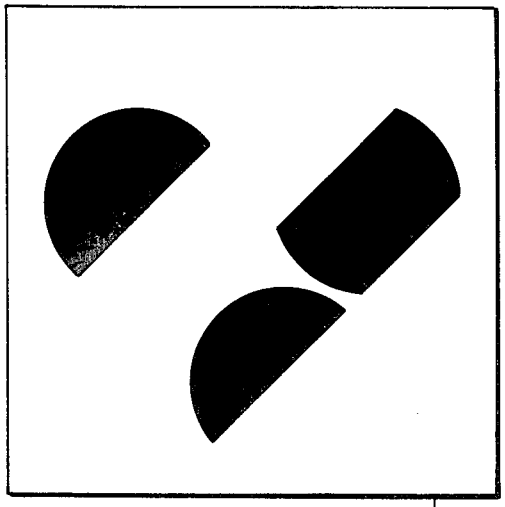
FIGS. 7, 16, 19 and 20A show side 2A of the second partial image sheet resulting from different steps in the method.
Figure 8:
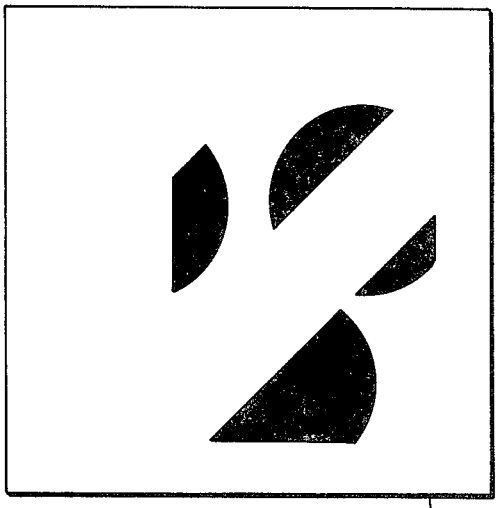
FIGS. 8, 9, 21 and 22 show side 3A of the third partial image sheet resulting from different steps in the method.
Figure 9:
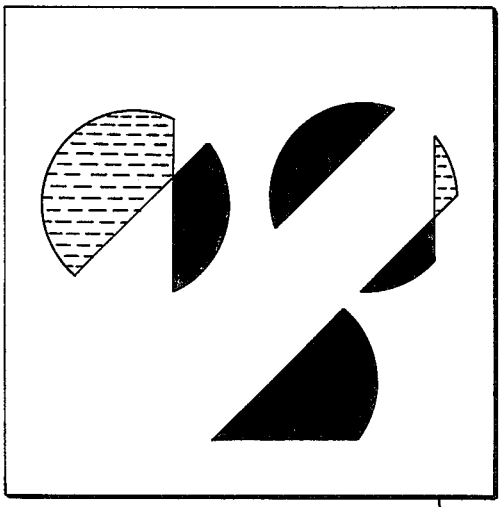

Now the steps in codification of the first image on the sides of the partial image sheets will be described. Side 1A of the first partial image sheet is located over FIG. 5. The portions of first image 2's dark areas which are not overlapped by second image 8's dark areas are painted on side 1A with black opaque paint. This area is clearly shown in FIG. 6. Next, side 2A is located over FIG. 4, and side 2A is painted black wherever the second image's dark areas are not overlapped by the third image's dark areas. These areas are shown in FIG. 7. Side 1A is then registered over side 2A over FIG. 1. Side 3A is located on top of side 1A and those areas of image one which are not covered up by the black areas on sides 1A or 2A are painted black. This is shown in FIG. 8.

In this application the term registered is used to denote the proper vertical placement of image sheets and partial image sheets, one over the other, so that each side has the same rotary orientation during each white and black paint application step as it had during the first step in which paint was applied to such side. Thus, a side is oriented the first time paint is applied thereto and registered thereafter.

At this point sides 1A over 3A over 2A produces first image 2, but also portions of second image 8 on side 2A show through. Side 3A is therefore registered over 2A over FIG. 1 and side 3A is painted with white opaque paint wherever the black opaque paint on side 2A extends beyond first image 2's dark areas. These areas painted white are indicated in the figures by horizontal dashed lines. In this case the boundary of first image 2, which is covered by portions of the black areas on side 2A, can be estimated with reasonable accuracy because of the simple shapes of the first and second images. However, with more complicated shapes it may be desired to place side 3A over FIG. 1 over side 2A so that the exact outline of first image 2 can be discerned with accuracy. First image 2 has now been transferred to sides 1A, 2A and 3A of the partial image sheets and thus has been preliminarily codified. Because of the codification of the second and third images which will take place, it will be necessary to adjust the codification of first image which has already been accomplished.

Codification of the Second Image

Image two will now be codified on the partial image sheets in such a way that image one will remain codified, although necessarily differently, and both images will be integrated on the same three sheets. First locate side 1B over 2A over 3A over FIG. 2. In the present example there are only four orientations in which side 1B can be located because of the sheets are square. Side 1B is located in such a way that as much as possible of the black areas on side 1A cover the yet to be blacked in dark areas of the second image. This is done recognizing that side 1B is used in producing the second image. Side 1B is now registered (its rotary orientation is noted) with sides 2A and 3A and FIG. 2 and painted black wherever portions of second image 8 are visible through side 1B. See FIG. 10.

Figure 10:
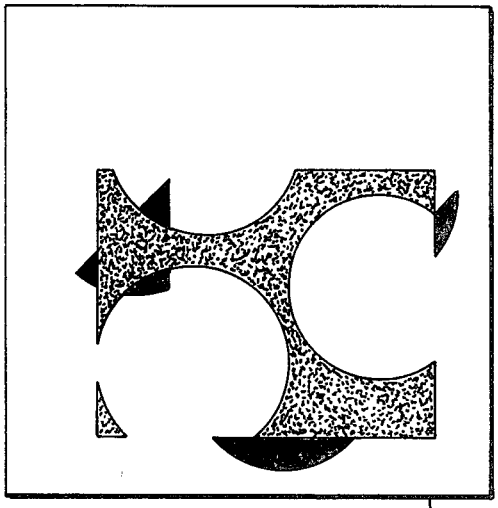
Figure 11:
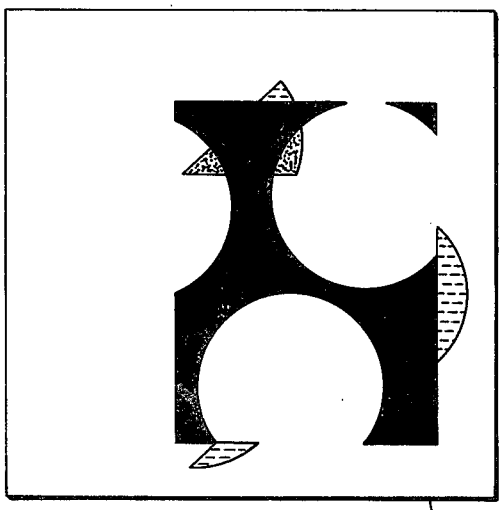

It should be noted that in the drawings a distinction is drawn between the black and white paint based upon whether it is applied on the side of the partial image sheet shown in the figure or is applied on the opposite side of the partial image sheet. As seen at FIG. 10, the portions of side 1A painted black but visible through the first partial image sheet have a speckled surface character while the areas painted on side 1B are solid black. Therefore, by reference to the type of shading in the figures, the side on which the black opaque paint is placed can be determined. It should also be noted that the shape of the image areas defined by the partial image sheets are regular polygons so that in solving the puzzle the user may arrange the partial image sheets in a finite number of ways. The greater the number of sides, the potentially more complex and time consuming the puzzle. If desired a round perimeter may be used for extreme complexity. However, registration of the partial image sheets over the original images and other partial image sheets is always accomplished by alignment in the rotary orientation as when the first white or black paint was placed on that side.

Figure 12:
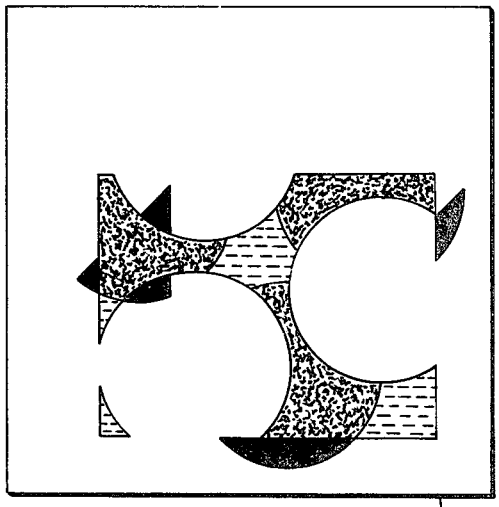

Side 1A is now registered over FIG. 1 and painted white wherever black paint on side 1B interferes with (overlaps into) the clear areas surrounding first image 2. Side 1B is registered over FIG. 2 and painted white wherever black paint on side 1A interferes with the clear areas surrounding second image 2. See FIG. 12. The codification of images one and two are now complete. This can be checked by placing sides 1A over over 3A over 2A which yields a black first image while registering sides 2A over 3A over 1B produces a black second image. It should be noted that the area surrounding the images will either be clear or painted with white opaque paint. Since the codification process for image three has not yet been completed, these clear areas have not yet been taken care of.

Codification of the Third Image

Figure 13:
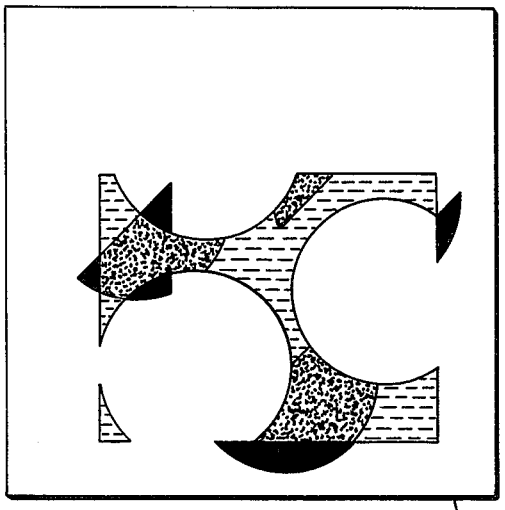
Figure 14:
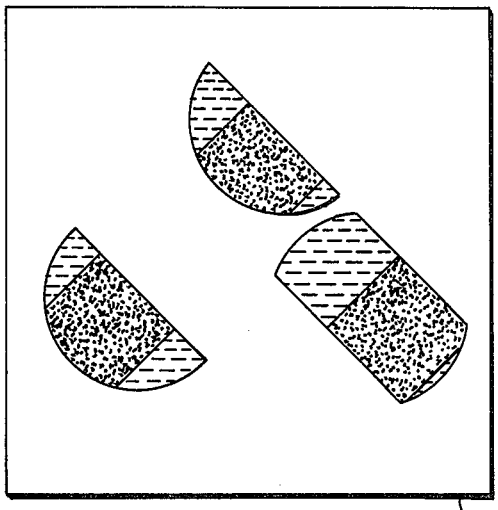
FIGS. 14, 15 and 20 show side 2B of the second partial image sheet resulting from different steps in the method.

To codify image three on the partial image sheets, first register side 1B over FIG. 3 and paint white the areas on side 1A painted black which interfere with the clear areas surrounding third image 12. See FIG. 13. Next, side 3A is added and registered over side 1B over FIG. 3. Side 2B, which has not yet had anything painted thereon, is located preferably in such a way that the dark areas of third image 12 that are yet to be covered up are covered up to a maximum possible extent by the black paint on side 2A. After the desired orientation is chosen, this orientation is noted for later registration and the areas on side 2A which interfere with the clear area surrounding third image 12 are painted white on side 2B. See FIG. 14.

Figure 15:
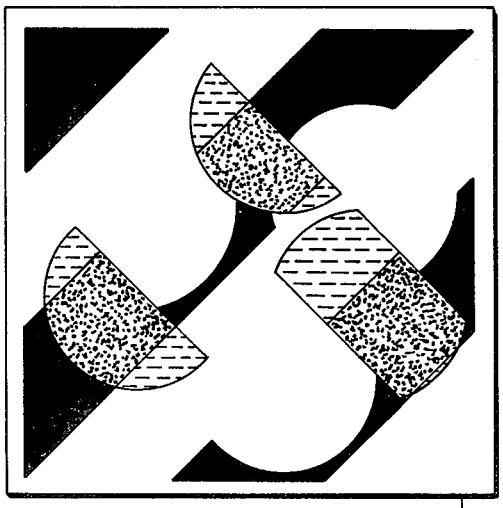

Using the same set-up, that is side 2B over 3A over 1B over FIG. 3, the areas in which third image 12's dark areas are visible are painted black. These areas are readily apparent by comparing FIGS. 14 and 15. Any white areas on side 1B which interfere with image three are masked by painting on side 2B with black paint. This is done because the sides 2B, 3A and 1B arrangement is exactly that used for producing image three.

Figure 16:
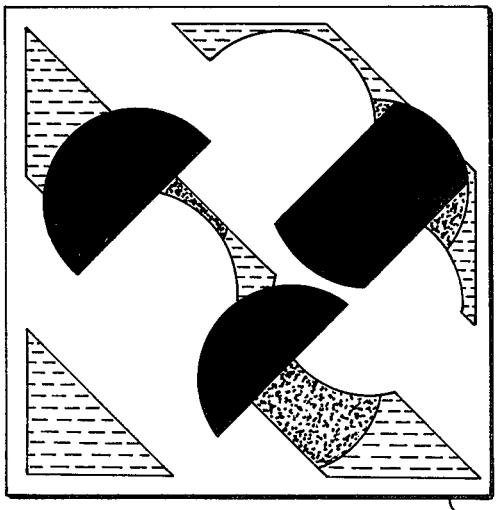
Figure 17:
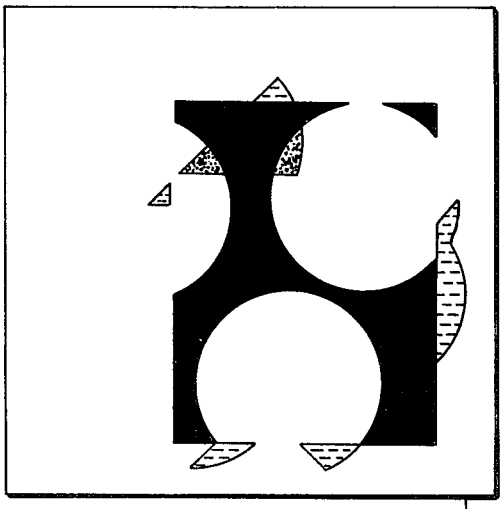

Now register side 2A over FIG. 2 and paint white wherever black paint is now found to interfere with the clear areas surrounding second image 8. See FIG. 16. Register sides 1A over 3A over 2A over FIG. 1 and paint white where black areas on any of the underlying sides interfere with the clear area surrounding first image 2. See FIG. 17. This completes the codification of all three images on the various sides of the three partial image sheets. However, this pertains only to the dark areas of images, not the clear areas surrounding the images. These must now be completed; white and black paint must now be added and codified to the sheets to give all the images, when formed, a uniform white background without clear areas seen through all three sheets.

Codification of the Background Areas

Figure 18:
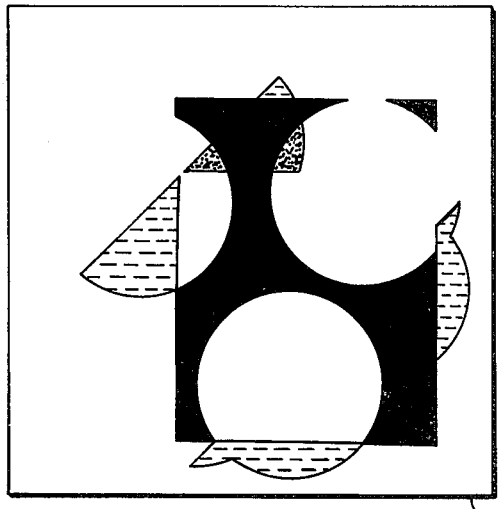
Figure 19:
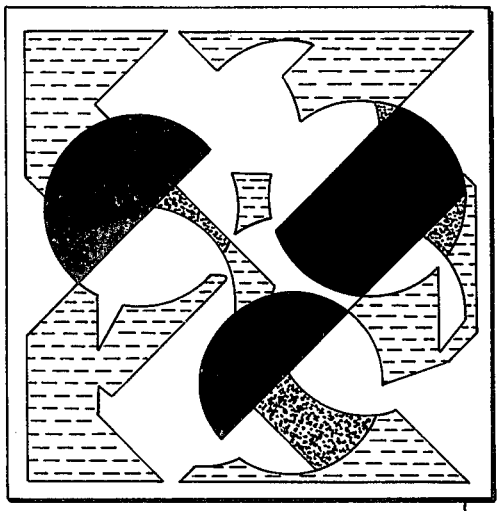
Figure 20:
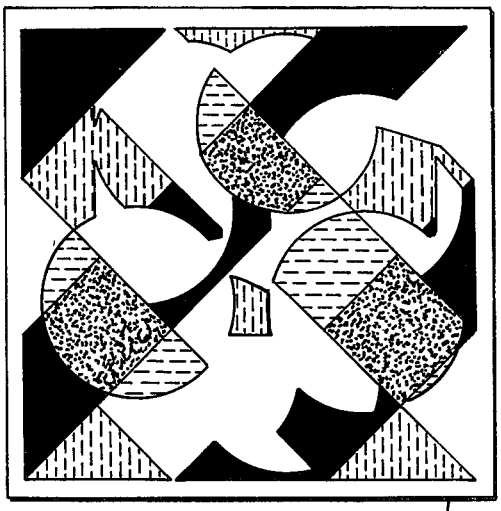
Figure 20A:
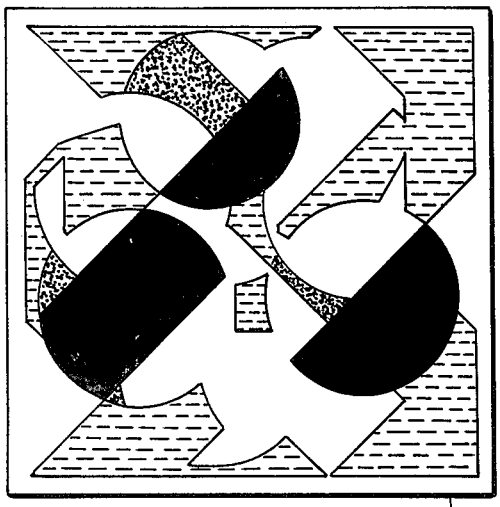

Register sides 1A over 3A over 2A over FIG. 5. Paint white wherever portions of second image 8's dark areas remain visible. These areas are shown in FIG. 18. Register sides 2A over 3A over 1B over FIG. 4 and paint white wherever third image 12's dark areas are visible. See FIG. 19. Side 2B is now registered over FIG. 4 and painted black wherever white paint interferes with third image 12's dark areas. See FIG. 20.

Figure 21:
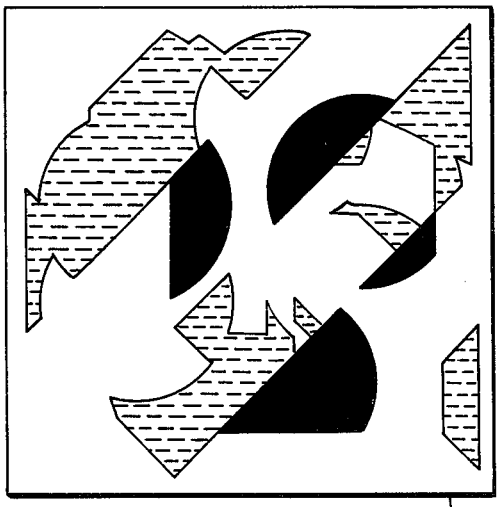
Figure 22:
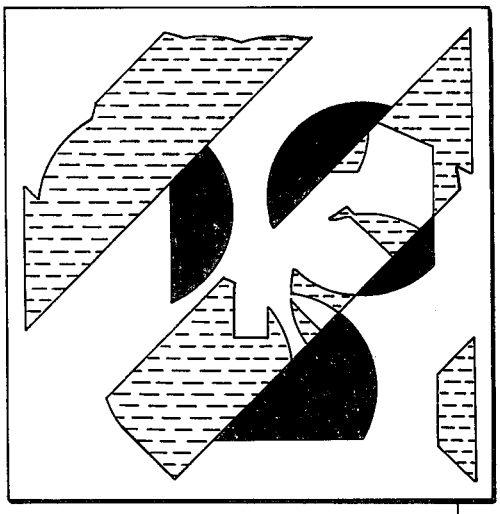
Figure 22A:
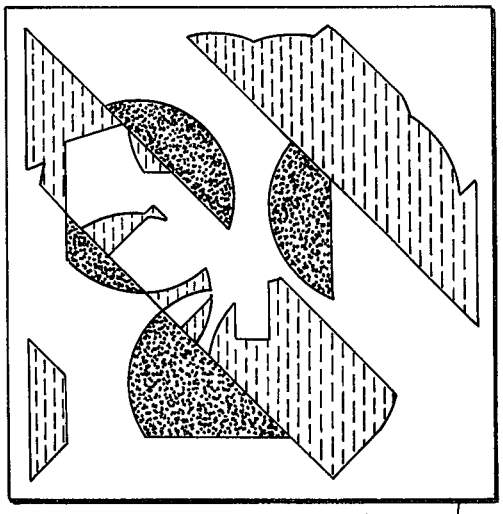
FIG. 22A shows side 3B of the third partial image sheet.

Register side 3A over 1B over 2B over FIG. 4. Paint white wherever second image 8's dark areas are visible. Also paint white wherever the clear portions surrounding third image 12 and second image 8 overlap and have not het been painted white. See FIG. 21. Next, register side 3A over 1B over 2A over FIG. 4 and paint white wherever the clear areas surrounding the second and third images overlap and have yet to be painted white. See FIG. 22. Although not needed with the simple images used, it may be required to also paint white wherever third image 12 is visible.

Register side 1A over 3A over 2A over FIG. 1 and paint white wherever the clear areas surrounding first image 2 are visible. See FIG. 23. Using the same arrangement, paint black those areas where white paint on side 3A interferes with first image 2. See FIG. 24. All the black and white areas of the three images have now been codified into an integrated pattern on the three sheets. FIGS. 24 and 24A, 20 and 20A, and 22 and 22A respectively show sides 1A and 1B, 2A and 2B, and 3A and 3B in their final forms.

It should be noted that in this example image area 4 having the first image is, when used, always on the bottom of the stack of image areas and partial image sheets. Therefore, first image 2 and background 6 can be opaque if desired.

Images containing half-toned areas (where small black dots are perceived as gray, the darkness dependent upon the fraction of area darkened) can likewise be accommodated by this process. The process would probably be mechanized or computerized because of the extremly small sizes of the resulting partial image portions. However, the concept remains the same.

Further, the process could be used to produce pastel colored puzzles. For example, each partial image sheet could be divided into a finely spaced grid, each grid square having four portions for accommodating the three primary colors plus black. The black information would always be stored in a certain portion, such as the upper left portion while the red information would be stored in a different portion, such as the upper right portion. If an individual grid square is to be painted red one of the four red portions of the grid is painted red while the other three are painted white, or left clear depending on the other image requirements thus producing a perception of a pastel red or pink to the observer. If a color other than a primary color is to be produced, such as purple, red from one partial image sheet and blue from another partial image sheet in corresponding grid squares combine to form purple. The unused squares are either clear or white. Of course, the number of steps involved is multiplied by a factor of four.

It should be apparent that other modification and variation can be made to the disclosed embodiment without departing from the subject of the invention. In particular, the various whiting-in and blacking-in steps can be altered and often combined. Further, a greater or lesser number of images can be codified on an equal number of partial image sheets. If two images are to be codified, three out of the four sides available for two partial image sheets are used for codification of the information. Any dark color can be used in lieu of black for the dark areas of the image and any light color can be used in lieu of white for the light or background areas in the codification the image information and background information.

I claim:

1. A visual puzzle comprising:

a plurality of partial image sheets, said sheets of a transparent material and having partial image portions of a first color and background portions of a second color formed thereon, said partial image portions and background portions formed on both sides of at least one of said partial image sheets, said image and background areas forming a first image or a second image when properly arranged in corresponding overlying relationships, said image portions and background portions formed on said partial image sheets by selectively masking portions of said first image with either said second image or other partial image sheets or both so that said image portions and said background portions are codified onto said partial image sheets.

2. The visual puzzle of claim 1 wherein there are three partial image sheets, said sheets forming three images when arranged in corresponding overlying relationships.

3. The visual puzzle of claim 2 wherein said partial image portions are formed on five out of the six sides of said partial image sheets.

4. A method for producing a visual puzzle comprising the following steps:

providing at least first and second image sheets, said sheets being transparent and having first and second images formed thereon, said second image being a transparent image;

providing at least first and second transparent partial image sheets;

overlaying said first and second image sheets to partially overlay said first and second images with the other;

placing said first partial image sheet over said overlayed first and second image sheets; and codifying portions of said first image which are not overlapped by said second image onto said first partial image sheet in a first, substantially opaque color.

5. The method according to claim 4 further comprising the steps of:

overlaying said second image sheet over a third image sheet having a third transparent image;

placing said second partial image sheet over said overlayed second and third image sheets; and codifying portions of said second image which are not overlapped by said third image onto said second partial image sheet in said first color.

6. The method according to claim 5 further comprising the steps of:

registering said first partial image sheet over said second partial image sheet over said first image sheet;

placing a third transparent partial image sheet over said registered first and second partial image sheets and said first image sheet; and codifying portions of said first image which are not overlapped by portions previously codified on said first and second partial image sheets onto said third partial image sheet in said first color.

7. The method according to claim 6 further comprising the steps of:

registering said third partial image sheets over said second partial image sheets over said first image;

applying a second, substantially opaque, color to said third partial image sheet where portions previously codified on said second partial image sheet in said first color extend beyond the area comprising said first image so that said first image is produced by registering said first, third and second partial image sheets are over the other.

8. The method according to claim 7 wherein said first color is substantially darker than said second color.

9. The method according to claim 8 wherein said first color is black and said second color is white.

10. A method for producing a visual puzzle comprising the following steps:

providing a plurality of image sheets having images and background portions formed thereon, at least one said image being transparent;

overlaying at least two of said image sheets to partially mask said images formed thereon;

providing a plurality of transparent partial image sheets;

placing a transparent partial image sheet over said overlayed image sheets;

codifying portions of said images on said partial image sheets in a first substantially opaque color, said portions defined by the areas of said images masked by said images; and selectively overlaying and registering said image sheets or partial image sheets or both and selectively codifying image portions in said first color or background portions in a second substantially opaque color or both on selected partial image sheets so that said partial image sheets when in a properly arranged overlying relationship form one of said images in said first color.

11. The method according to claim 10 wherein said second color is white.

12. The method according to claim 10 wherein there are three images and three partial image sheets.

* * * * *